US005235728A

United States Patent [19]

Nordberg

[11] Patent Number: 5,235,728

[45] Date of Patent: Aug. 17, 1993

[54] FASTENING DEVICE FOR PORTABLE EQUIPMENT AND METHOD OF USING SAME

[75] Inventor: Svein T. Nordberg, San Diego, Calif.

[73] Assignee: H.M. Electronics, Inc., San Diego, Calif.

[21] Appl. No.: 922,993

[22] Filed: Jul. 30, 1992

[51] Int. Cl.[5] ..... A44B 21/00; A45F 5/00

[52] U.S. Cl. ..... 24/3 J; 24/3 R; 24/3 F; 224/252

[58] Field of Search ..... 24/3 J, 3 R, 3 F, 3 L, 24/3 H, 3 A; 224/252

[56] References Cited

U.S. PATENT DOCUMENTS

| | | | |
|---|---|---|---|
| 3,294,298 | 12/1966 | Danielson | 224/252 |
| 3,631,994 | 1/1972 | Mackizum, Jr. | 224/252 |
| 3,808,642 | 5/1974 | Nation | 24/3 F |
| 4,083,481 | 4/1978 | Selinko | 224/252 |
| 4,635,836 | 1/1987 | Mooney et al. | 224/252 |
| 4,780,934 | 11/1988 | Vickers et al. | 24/3 J |
| 4,956,895 | 9/1990 | Hayasaka | 224/252 |
| 5,038,985 | 8/1991 | Chapin | 24/3 J |
| 5,081,709 | 1/1992 | Benyo et al. | 224/252 |

*Primary Examiner*—Victor N. Sakran

*Attorney, Agent, or Firm*—Bernard L. Kleinke; Jerry R. Potts

[57] ABSTRACT

A fastener includes a base plate for permitting the portable equipment to be supported from the apparel of a user. An apparel clip is mounted pivotally to the base plate for moving between open and closed position for securing removably the apparel of the user to the portable equipment. In one form of the invention, the apparel clip is biased by a spring to a closed position in order to permit the portable equipment to be attached to the waistband of the user. In another form of the invention, the apparel clip is locked to the portable equipment so the wearing apparel captured by the apparel clip is incapable of being released from the clip except by the direct action of the user.

3 Claims, 2 Drawing Sheets

FASTENING DEVICE FOR PORTABLE EQUIPMENT AND METHOD OF USING SAME

DESCRIPTION

1. Technical Field

This invention relates in general to a fastening device and method of using it and more particularly relates to a fastening device for securing portable equipment to the apparel of a user.

2. Background Art

Today's fast food industry is extremely competitive. In this regard, those competing in fast food restaurants must not only provide food products at low competitive prices, but they must also provide fast efficient service.

In order to provide fast efficient service, most if not substantially all of the major fast food restaurants, employ very sophisticated and expensive communication systems. Also, to provide such food products at low competitive prices, most of the fast food restaurants also utilize young, inexperienced employees, such as high school and college students.

As such young inexperienced students are exuberant, playful and carefree, such students many times bump into not only counters and the like, but also into one another as they rush to carry out their duties. Such abrupt collisions oftentimes result in the expensive communication system becoming damaged or destroyed.

More particularly, in order to help expedite customer service, such employees wear portable wireless electronic communication devices, including headphones, microphones, and full duplex voice communication units. As such devices are portable and wireless they also require long lasting rechargeable batteries that are both heavy and bulky. Thus, when an employee accidentally bumps into a counter or another employee, the force generated by the electronic unit and its associated energy source in response to the collision is quite considerable. In this regard, many times the force is so great, the electronic unit is dislodged from the wearing apparel of the user, allowing the unit to fall to the floor. Again, because of the disportionate weight differences between the electronic unit and its associated battery, such a fall will result in the electronic unit being irreparably damaged.

Such units may also be damaged accidentally from time to time, whenever a user bends over to pick up an item which may have fallen to the floor. In this regard, conventional devices for securing such units to the wearing apparel of a user oftentimes open failing to properly secure the device to the wearing apparel. Thus, when the device opens, the unit falls to the ground resulting in damage.

Several attempts have been made to overcome the above-mentioned problem. One attempt for example, has been to employ an apparel clip which is secured to the electronic unit for supporting the electronic unit and its associated battery from the waistband of the user.

While such an arrangement is usually satisfactory for less active employees, an apparel clip does not sufficiently secure such a unit to the apparel of the user to prevent the unit from being dislodged as the result of an abrupt collision.

Therefore, it would be highly desirable to have a fastening device that would secure an electronic unit to the apparel of a user so that the unit can not be dislodged from the apparel of the user even if the user employee bumps into a counter or another employee.

Another attempt at solving the above-mentioned problem has been to provide belt receiving slots on the electronic unit to permit the unit to be attached to a belt worn by the user. While this solution prevents the unit from falling to the floor as a result of an abrupt collision, the slots have not proven entirely satisfactory. In this regard, when such a unit suffers an impact by the user employee bumping into a counter or other object, the unit is capable of being displaced along the belt of the user resulting in the interconnecting wires between the electronic device and the headphones and microphone being broken or in injury to the head or neck of the user. Moreover, when the user removes his or her belt the unit may also fall to the floor should the belt become disengaged from the loops on the unit.

Therefore, it would be highly desirable to have a fastening device that would secure an electronic unit in a stationary manner so that interconnecting wires or cables are incapable of being pulled or broken as the result of an abrupt collision. Moreover, such a device would not be able to be separated from the apparel of the user except by direct action of the user.

DISCLOSURE OF INVENTION

Therefore, it is the principal object of the present invention to provide a new and improved fastening device for attaching a portable unit to the apparel of a user so that the communication unit is prevented from being dislodged from the apparel of the user, even if the user bumps into a counter or other stationary object.

Another object of the present invention is to provide such a new and improved fastening device for attaching a portable unit in such a stationary manner to the apparel of a user that the interconnecting wires or cables of the unit are incapable of being pulled or broken as a result of the user colliding with a counter or other stationary or moving object.

Another object of the present invention is to provide such a new and improved fastening device for attaching a portable unit in such a stationary manner to the apparel of a user that the unit cannot be separated from the apparel of the user except by direct action of the user.

Briefly, the above and further objects of the present invention are realized by providing a fastener for portable equipment which secures the portable equipment to the apparel of the user in such a stationary manner that the portable equipment cannot be separated from the apparel except by the direct action of the user.

A fastener includes a base plate for permitting the portable equipment to be supported from the apparel of a user. An apparel clip is mounted pivotally to the base plate for moving between open and closed position for securing removably the apparel of the user to the portable equipment. In one form of the invention, the apparel clip is biased by a spring to a closed position in order to permit the portable equipment to be attached to the waistband of the user. In another form of the invention, the apparel clip is locked to the portable equipment so the wearing apparel captured by the apparel clip is incapable of being released from the clip except by the direct action of the user.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
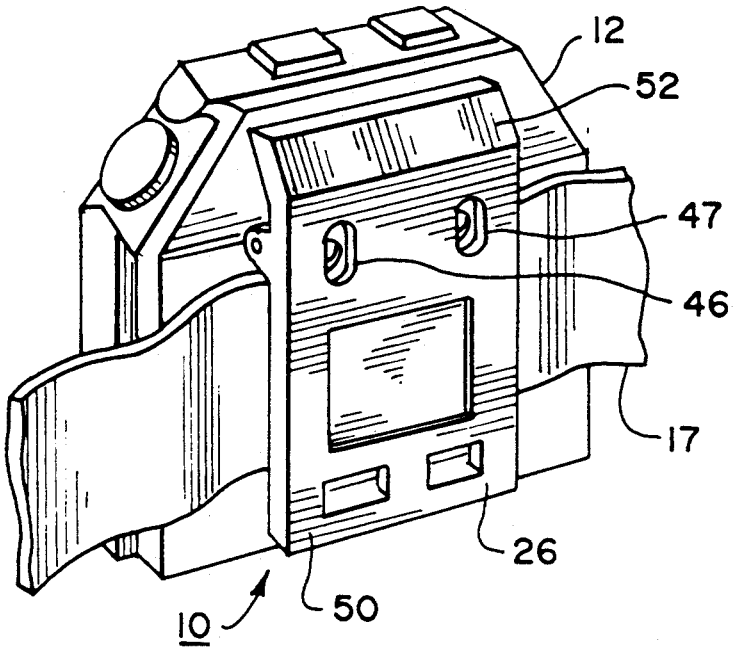
FIG. 1 is a pictorial view of a fastener device attached to the belt of a user.

Referring now to the drawings, and more particularly to FIGS. 1-4 thereof, there is shown a fastener device 10, which is constructed in accordance with the present invention. The fastener is adapted to be mounted to portable equipment, such as a portable wireless communication unit 12.

While a portable wireless communication unit is shown as described herein, it is to be understood by those skilled in the art, that other types and kinds of portable equipment, such as radios, cassette players, packaging units, and others, may also be used, with the fastener of the present invention.

The fastener 10 generally comprises a base plate generally indicated at 16 adapted to be mounted to a rear face portion 14 of the portable unit 12. In this regard, the base plate 16 includes a pair of spaced apart oppositely disposed elongated open slots 18 and 20 adapted to receive a set of mounting screws 22 and 24 respectively for mounting purposes. A mounting surface 15 disposed on the rear face of the portable unit 12 includes a pair of spaced apart oppositely disposed threaded holes 19 and 21 adapted to threadably receive therein, the screws 22 and 24 respectively.

Figure 3:
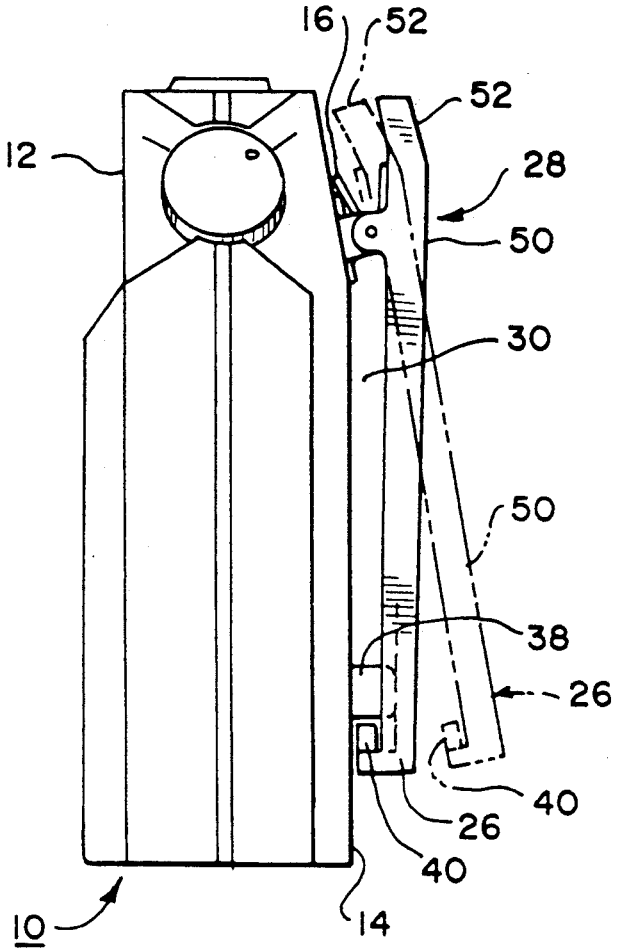
FIG. 3 is a slightly enlarged side elevational view of the fastener device of FIG. 1, illustrating an apparel clip disposed between open and closed positions.
Figure 4:
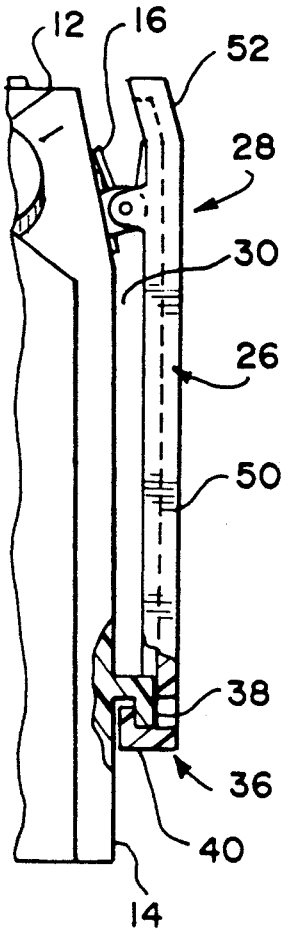
FIG. 4 is a slightly enlarged side elevational view of the fastener device of FIG. 1, illustrating the apparel clip in a locked position.

An apparel clip 26 permits the communication unit 12 to be secure removably to the apparel 17 of a user (not shown). A spring pivot assembly 28 is mounted between the base plate 16 and the apparel clip 26 for securing the base plate 16 and the apparel clip 26 together pivotally. In this regard, the apparel clip 26 pivots about the base plate 16 from open and closed positions as illustrated in FIG. 3 to permit the apparel of a user to be received and constrained within an apparel receiving space 30. A spring 32 mounted to the pivot assembly 28 holes the apparel clip 26 under tension in a closed position.

In order to prevent the fastener 12 from being separated from the apparel 17 of the user, the fastener 12 also includes an apparel clip locking arrangement, generally indicated at 36. In this regard, as will be explained hereinafter in greater detail, the locking arrangement 36 secures the apparel clip 26 to a locking bar 38 mounted to the rear face 14 spaced apart from the mounting surface 15. The locking arrangement 36 includes a pair of spaced apart L-shaped locking teeth 39 and 40 which project perpendicularly outwardly from an underside surface 27 of the apparel clip 26. The teeth 39 and 40 are adapted to be received within a pair of open slots 38A and 38B respectively, disposed within the locking bar 38.

In use, in order to attach the electronic device 12 to the apparel 17 of the user, the user presses downwardly on the raised end of the apparel clip 26 to enable the apparel clip 26 to pivot about the base plate 16 to an opened position as shown in dotted line in FIG. 3. In this regard, after the apparel clip 26 is pivoted to an open position, the apparel 17 is slipped into the apparel receiving space 30 between the rear face 14 of the communication unit 12 and the underside surface 27 of the apparel clip 26.. The user then releases his or her downward pressure from the apparel clip, permitting the spring 32 to move the apparel clip 26 back to a closed position.

Figure 6:
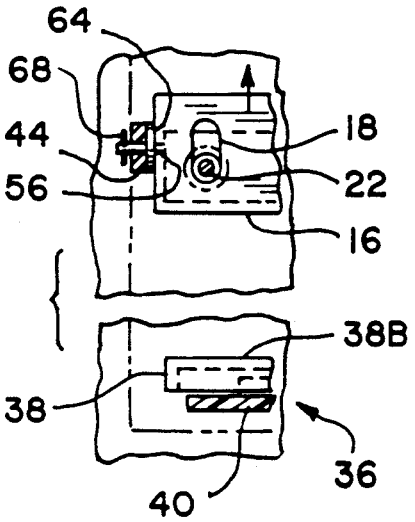
FIG. 6 is a fragmentary view of the base plate of FIG. 2, illustrating the base plate adjusted to a position for causing the apparel clip to be disposed in a locked position.

Once the apparel 17 has been captured within the space 30, the user loosens the screws 22 and 24 respectively a sufficient amount to permit the base plate 16 to be slid upwardly until the screws 22 and 24 are disposed at the bottom of slots 18 and 20 respectively (FIG. 6). As the base plate 16 is attached to the apparel clip 26 via the pivot assembly 28, the apparel clip 26 is moved in unison with the base plate 16 causing the teeth 39 and 40 to be received within slots 38A and 38B respectively (FIG. 6). The user then tightens the screws 22 and 24.

In this manner, the apparel clip 26 is locked to the locking bar 38 and thus prevents the apparel 17 from being removed from the apparel receiving space 30.

Figure 5:
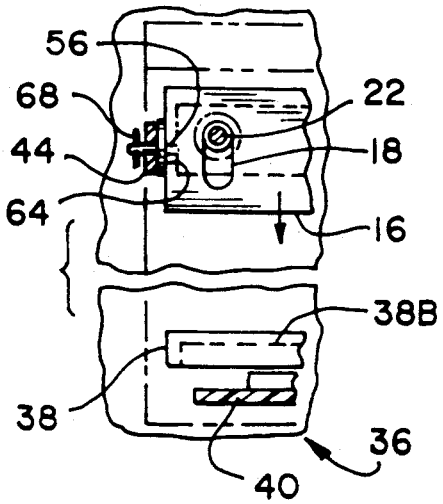
FIG. 5 is a fragmentary view of a base plate of FIG. 2, illustrating the base plate in an adjusted position for causing the apparel clip to be unlocked.

To remove the apparel 17 from the apparel receiving space 30, the user reverses the above described steps. In this regard, the user loosens the screws 22 and 24 a sufficient amount to permit the base plate 16 to be slid downwardly until the screws 22 and 24 are disposed at the top of slots 18 and 20 respectively (FIG. 5). As the user moves the apparel clip 26 downwardly, the base plate is moved in unison and the teeth 39 and 40 are retracted from within the slots 38A and 38B respectively. The user then presses downwardly on the raised end of the apparel clip 26 to enable the apparel clip 26 to pivot about the base plate to an opened position. Once the apparel clip 26 is disposed in an opened position, the apparel 17 is removed from the apparel receiving space 30.

Once the apparel 17 has been removed from the space 30, the user releases the apparel clip 26, permitting the spring 32 to once again move the clip 26 back to a closed position. The user then tightens the screws 22 and 24 to fix the base plate 16 to the communication unit 12.

Figure 2:
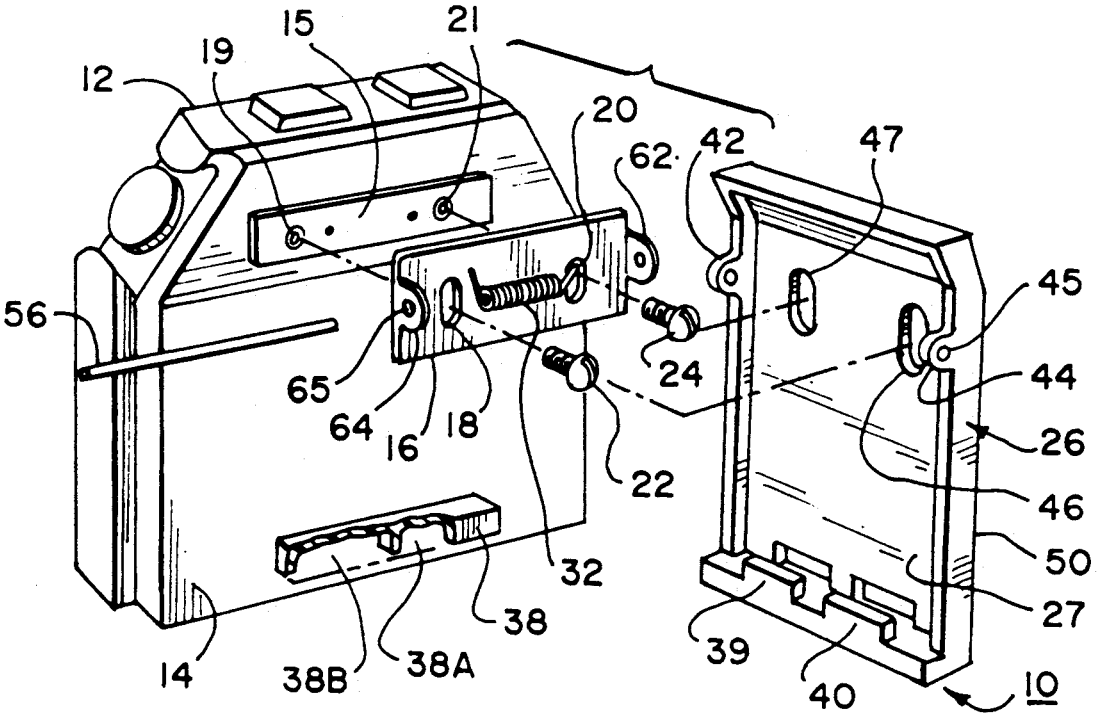
FIG. 2 is an exploded pictorial view of the fastener device of FIG 1.

Considering now the apparel clip 26 in greater detail with reference to FIG. 2, the apparel clip 26 has a unitary construction and is composed of a suitable plastic material, such as an electronic plastic material. The apparel clip 26 is generally rectangularly shaped and includes a front face portion 50 and a finger engageable portion 52. The finger engageable portion 52 inclines downwardly from the front face portion by an angle $\theta$ to help limit the path of travel of the finger engageable portion 52 when it is pressed downwardly towards the communication unit 12.

As best seen in FIGS. 1 and 2, the front face portion 50 includes a pair of oppositely disposed spaced apart open slots 46 and 47 to permit the mounting screws 22 and 24 to be loosened and tightened when the apparel clip 26 is in either an opened or closed position. The slots 46 and 47 are configured to be in corresponding alignment with slots 18 and 20 respectively when the clip 26 is mounted to the base plate 16.

The front face portion 50 also includes a pair of spaced apart openings 48 and 49 for helping the apparel clip 26 and the teeth 39 and 40 to be manufactured utilizing standard plastic molding procedures.

In order to facilitate attaching the apparel clip 26 to the pivot assembly 28, the apparel clip 26 further includes a pair of upstanding spaced apart U-shaped posts 42 and 44. Each post, such as post 44 includes a hole, such as a hole 45 for receiving a pivot pin 56. The posts 42 and 44 are disposed at the outer peripheral boundary of the front face 50 and project upwardly from the underside 27.

Considering now the base plate 16 in greater detail with reference to FIGS. 2, 5 and 6, the base plate 16 has unitary construction and is composed of a suitable metallic material, such as sheet metal. The base plate 16 is generally rectangularly shaped and includes a pair of upstanding spaced apart U-shaped posts or ears 62 and 64. Each post, such as post 64 includes a hole, such as a hole 65 for receiving the pivot pin 56 therein. The posts 62 and 64 are spaced apart a sufficient distance to be received between and adjacent to posts 42 and 44 when the apparel clip 26 is mounted to the base plate 16.

In order to mount the apparel clip 26 to the base plate 16, the user slides the pivot pin through holes 45 and 65 respectively securing legs 44 and 64 together. The user then slides the pivot pin through a hole extending the entire longitudinal length of the spring 32, and then through the holes in posts 62 and 42 respectively. A small lock washer, such as a lock washer 68, is attached to each end of the pivot pin 56 to secure the pivot pin within the assembly 28.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A fastening device for portable equipment, comprising:

base plate means mounted positionally adjustably to an external face of the portable equipment for permitting the portable equipment to be supported from the apparel of a user;

apparel clip means disposed on said base plate means to attach said clip means to said base plate means for facilitating simultaneous positional adjustment of said clip means and said base plate means, said clip means having an underside surface adapted to be opened and closed pivotally about said base plate means at one end of said clip means for securing removably the apparel of the user to the portable equipment;

locking means disposed on said clip means underside surface at an opposite end thereof for securing lockingly said apparel clip means to the portable equipment and for preventing the portable equipment from being removed from the apparel of the user;

tightening means disposed between said clip means and said equipment external face for positioning adjustably said clip means relative to said locking means to secure said clip means in a lock position and for positioning adjustably said clip means relative to said locking means in an unlocked position, said tightening means including a mounting screw to affix positionally adjustably said base plate means and said clip means to said external face at an opening therein; and said tightening means further includes means defining a pair of elongated aligned open slots in said base plate means and said clip means for receiving therein said mounting screw.

2. A fastening device according to claim 1, wherein said locking means includes a locking bar mounted to said external face of the portable equipment and locking teeth disposed on said underside surface opposite end to slidably engage said locking bar for securing lockingly said opposite end to said external face.

3. A method for fastening portable equipment to the apparel of a user, comprising:

attaching positionally adjustably base plate means to the rear face of the portable equipment;

mounting pivotally apparel clip means to said base plate means to permit said apparel clip means to be opened and closed pivotally about said base plate means;

causing said apparel clip means to be opened to define an apparel receiving space;

inserting a portion of the apparel of the user into said apparel receiving space;

causing said apparel clip means to be closed for securing the apparel within said apparel receiving space;

causing said base plate means and said apparel clip means to be positioned adjustable simultaneously to a locked position to prevent the apparel of the user from being removed from said apparel receiving space; and tightening a mounting screw to prevent further positional adjustment of said base plate means and said apparel clip means.

* * * * *